US011084680B1

(12) United States Patent
Widener et al.

(10) Patent No.: US 11,084,680 B1
(45) Date of Patent: Aug. 10, 2021

(54) CONTINUALLY RUNNING POCKET SPINDLE

(71) Applicant: Imaging Business Machines LLC, Birmingham, AL (US)

(72) Inventors: Mark Pilgrim Widener, Birmingham, AL (US); Eddie L. Groom, Trussville, AL (US); Robert Babanats, Vestavia Hills, AL (US)

(73) Assignee: Imaging Business Machines LLC, Birmingham, AL (US)

( * ) Notice: Subject to any disclaimer, the term of this patent is extended or adjusted under 35 U.S.C. 154(b) by 183 days.

(21) Appl. No.: 16/373,078

(22) Filed: Apr. 2, 2019

Related U.S. Application Data

(60) Provisional application No. 62/653,368, filed on Apr. 5, 2018.

(51) Int. Cl.
*B65H 29/40* (2006.01)
*B65H 31/12* (2006.01)

(52) U.S. Cl.
CPC ..... *B65H 29/40* (2013.01); *B65H 31/12* (2013.01); *B65H 2301/4212* (2013.01); *B65H 2301/4214* (2013.01); *B65H 2404/654* (2013.01); *B65H 2513/108* (2013.01); *B65H 2701/19* (2013.01)

(58) Field of Classification Search
CPC ..... B65H 29/40; B65H 2301/33214; B65H 2404/65; B65H 2404/651; B65H 2404/652; B65H 2404/653; B65H 2404/654; B65H 2404/657; B65H 2404/658; B65H 31/12; B65H 2301/4212; B65H 2701/19; B65H 2301/4214
See application file for complete search history.

(56) References Cited

U.S. PATENT DOCUMENTS

| | | | | |
|---|---|---|---|---|
| 4,222,556 A | | 9/1980 | Chapman | |
| 4,638,993 A | * | 1/1987 | Granzow | B65H 29/40 271/187 |
| 4,790,526 A | * | 12/1988 | Egashira | B65H 29/40 271/187 |
| 6,216,591 B1 | | 4/2001 | Nanba | |
| 7,040,618 B2 | | 5/2006 | Moench | |
| 7,318,586 B2 | | 1/2008 | Leuthold | |
| 2005/0023746 A1 | | 2/2005 | Michler | |

* cited by examiner

*Primary Examiner* — Jeremy R Severson
(74) *Attorney, Agent, or Firm* — Harris Beach PLLC

(57) ABSTRACT

This disclosure relates to a method and apparatus for taking flexible sheets off a delivery belt, such as from a scanner or copier, and restacking them in the order and orientation (face) they were originally scanned in. This requires flipping over such sheets by use of a spindle wheel with a plurality of fingers defining slots therebetween for receiving the sheets and reversing their face (flipping). By knowing the speed of the delivery belt and using a continuously spinning spindle wheel it is possible to avoid the effects of momentum on the fingers which distorts their position during stopping and starting action. Instead, the spindle wheel is in constant rotation but the speed of rotation is adjusted from a first speed, then a second tapering speed, to a third speed which is adapted to ensure that the slot between fingers is accurately presented to the leading edge as it enters the slot and does not get rejected by an accidental encounter with a finger.

13 Claims, 7 Drawing Sheets

The following diagram illustrates determining the required number of steps to reach an entry position:

CONTINUALLY RUNNING POCKET SPINDLE

TECHNICAL FIELD

The present disclosure relates to devices for scanning documents, more particularly a system for stacking documents after leaving a scanning station.

BACKGROUND

In high volume scanners, throughput is of the utmost importance. Part of scanning is the need to restack documents in the order scanned. This requires turning/flipping over each page as it comes in and stacking it.

Spindles, starwheels or spirally slotted stacking wheels are known in the art for this purpose, for example U.S. Pat. No. 7,040,618 to Moench, U.S. Pat. No. 6,216,591 to Nanba, U.S. Pat. No. 4,222,556 to Chapman et al, U.S. Pat. No. 7,318,586 to Leuthold and US Publication No. 2005/0023746 to Michler et al.

After the scanner ejects a document from a scanning station, it must be turned/flipped over to a face down position so that it can be stacked in the same order as it was scanned. A stepper motor and position encoder position a series of spindles to the next available document slot in the spindle and the motor is stopped until a document is directed into the selected pocket. The document is driven into the spindle fingers by a series of rollers until the document is sufficiently engaged in the spindle fingers. At this point the spindle motor starts and rotates the spindle to the next available slot and the process repeats. Note that several documents may rest in the various spindle slots at any given time. When the document has traveled around the spindle to the face down position, it is stripped off and falls on top of other documents in a stack. This process requires precision motor control timing. The spindle motor is required to have sufficient torque to overcome the inertia of the spindle wheel and associated mechanics, position the spindle to the next slot, and stop the spindle in the tens of milliseconds time.

This process is known to create vibration in the fingers when the spindles start or stop. Vibration is caused primarily from the momentum in the fingers. As speeds increase, the inertia and momentum of the fingers extending from the wheels increases and the fingers are affected by centrifugal force. Furthermore, if the wheel is operated in a start/stop mode, these centrifugal forces cause the fingers to become mispositioned and can fail to perform their function reliably.

During startup, the spindle wheel seems to demonstrate a vibration pattern that begins at the center of the spindles and moves outward to the fingers as the spindle gets up to speed. Immediately after the spindle wheel starts or stops, a "dampening" of the vibration occurs until the spindle appears to move smoothly. The vibrating motion of the spindle fingers is difficult to compensate for when attempting to consistently catch documents. Additionally, the vibration of the fingers can potentially pinch the document as it is being inserted between the spindle fingers. The pinching of the document between spindle fingers can cause the documents to be stacked inconsistently.

In addition to causing the spindle fingers to vibrate, our current method of starting and stopping the spindle wheel between documents may not be consistent. We have found that a spindle wheel which uses start/stop, does not consistently stop at the same position every time. Inconsistent positioning of the spindle wheel after start and stops could be a result of a couple of issues.

One issue is that the spindle wheel is not physically moving smoothly or at a consistent speed immediately after being commanded. Another issue is that sensor data and controls used to establish the start/stop points may not be responsive enough to consistently position the spindle wheel. To fix this second point, if it can be fixed, much more expensive control systems would be required.

The current spindle start/stop technology limits the maximum speed of the transport by limiting the speed at which documents can be pocketed. The physics of starting, accurately positioning the spindle, and stopping the spindle is the limiting factor in the total throughput of the scanning system. As the scanner increases in speed, the benefit may not be obtained if the documents cannot be reliably restacked at the same speed.

SUMMARY

The disclosure encompasses many embodiments. One such embodiment is detailed below in summary fashion. Please understand that this summary does not encompass the entire disclosure but is provided to assist the reader in reviewing the entire disclosure and claims which also constitute part of the disclosure.

There is, for example, disclosed, a system for stacking flexible sheets having a leading edge, the system having any or all of the following:

a. a transfer belt configured to move in a transverse direction to move said sheet transversely therealong at a predetermined speed. The transfer belt is not part of the invention but stated to understand the movement of the sheets.

b. at least one sensor located proximate the belt positioned to detect a sheet. The sensor can be an array and it can compensate for sheets which are misaligned such that the leading edge is skewed.

c. a rotatable stacking spindle wheel having a central core and a plurality of arcuate fingers extending generally outwardly from the core, said fingers defining a slot therebetween, said wheel located adjacent said belt. There can be multiple wheels spaced apart side by side which can rotate together or independently.

d. a motor connected to said wheel for rotating said wheel. The preferred embodiment contemplates stepper motors but any rotation control over the motor will suffice.

e. a controller configured to control the rotational speed of said motor and to receive position data from said sensor; said controller configured to adjust the rotational speed of said wheel to ensure that when the leading edge of a sheet arrives at said wheel, it is directly received within said slot, so that it can be flipped over by said wheel and released therefrom for stacking after sufficient rotation of the wheel. The slot(s) is the space between fingers and the leading edge of the sheet should glide into the slot only guided by the sidewalls of the fingers until it reaches a predetermined depth which is sufficient for the flip over rotation. If it encounters the tip end of any finger it will fail to engage a slot. This could happen if the rotation is not adjusted so that the slot is always presented to the leading edge.

Also disclosed is a system wherein the controller is configured to adjust the wheel speed from a first speed where the sheet is traveling along the transfer belt after said leading edge has been detected by the sensor, a second variable speed after the sheet is detected by the sensor but before it arrives at the wheel, and a third speed at the moment before the leading edge reaches the wheel.

Also disclosed is a system wherein said second speed is a substantially linear reduction in speed from said first speed.

Also disclosed is a system wherein the second speed is a progression from the first to the third speed.

Also disclosed is a system wherein the second speed is variable with a final speed adapted to insert the leading edge of the sheet at least part way into the slot without encountering a finger.

Also disclosed is a method of stacking flexible sheets traveling on a transfer belt with the sheets in one orientation and stacking them in a reverse or regular orientation (such as face up/face down), each sheet having a leading edge, a sheet pickup spindle wheel located proximate the end of the belt, the wheel having a plurality of fingers and slots between the fingers, comprising the steps of, in any order:

a. moving a sheet along a transfer belt at a predetermined speed;
b. once the sheet is moving on the transfer belt, continuously rotating the spindle wheel without stopping;
c. detecting the leading edge of the sheet while moving the sheet on the belt at the predetermined speed;
d. calculating when the leading edge will reach the spindle wheel;
e. as the sheet approaches the wheel, adjusting the rotational speed of the wheel such that when the leading edge reaches the spindle wheel, the leading edge will directly engage a slot between fingers;
f. rotating the wheel to flip over the sheet from one orientation to the reverse orientation; and
g. stacking the sheet.

Also disclosed is a method wherein said wheel is rotated in discrete steps but which appears as continuous motion over time.

Also disclosed is a method wherein the speed of the wheel starts at a high speed and changes to a lower speed suitable for receiving the leading edge with the speed of rotation, in incremental wheel steps being calculated as follows:

$$\begin{cases} N_H = r_H \cdot (N_{req} - (N_{min} + N_R)) \\ N_L = r_L \cdot ((N_{max} + N_R) - N_{req}) \end{cases}$$

Where:

$N_H$=Number of high-speed wheel steps issued as the document's leading edge traverses the gap between the track sensor and the wheel entry point, typically but not necessarily occurring at the start of gap traversal (in steps);

$N_R$=Number of ramping wheel steps issued to decrease the wheel speed from high speed to low speed as the document's leading edge traverses the gap between the track sensor and the wheel entry point, typically but not necessarily occurring together in an interval between the high-speed and low-speed intervals (in steps);

$N_L$=Number of low-speed wheel steps issued as the document's leading edge traverses the gap between the track sensor and the wheel entry, typically but not necessarily occurring at the end of this traversal (in steps);

$N_{req}$=Number of wheel steps required to be issued as the document's leading edge traverses the gap between the track sensor and the wheel entry point in order for a wheel entry position to be presented to the document at the end of this traversal;

$N_{min}$=Minimum possible number of wheel steps issued outside of ramping as a document's leading edge traverses the gap between the track sensor and the wheel entry point (in steps);

$N_{max}$=Maximum possible number of wheel steps issued outside of ramping as a document's leading edge traverses the gap between the track sensor and the wheel entry point (in steps);

$r_H$=Ratio of high wheel speed to difference of high and low wheel speeds;

$r_L$=Ratio of low wheel speed to difference of high and low wheel speeds.

Also disclosed is a method wherein the step of continuously rotating the spindle wheel without stopping includes, rotating the wheel at a first predetermined speed, adjusting the rotation of the wheel toward a second speed, and adjusting the speed to a third speed which is calculated to align a slot between fingers with the leading edge sheet.

Also disclosed is a method wherein the second speed is a plurality of speed adjustments to bridge between the first and third speeds.

Also disclosed is a method wherein said bridge speed is substantially linear to minimize sudden changes in momentum of the wheel.

The first equation in the system is graphed in the single sloped line 10 and the second is graphed in multiple sloped lines 12 for various values of k. The points of intersection in the first quadrant, marked with diamonds (14), represent valid solutions (step count pairs ($N_H$, $N_L$) meeting both constraints and lying in the constrained ranges).

Figure 3:
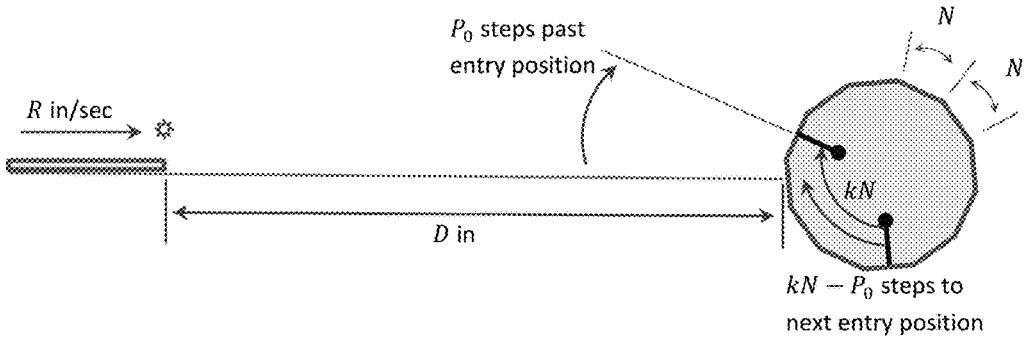

FIG. 3 is a schematic view of a spindle wheel showing the desired number of steps to an entry position (slots between fingers) on the spindle wheel.

Figure 4:
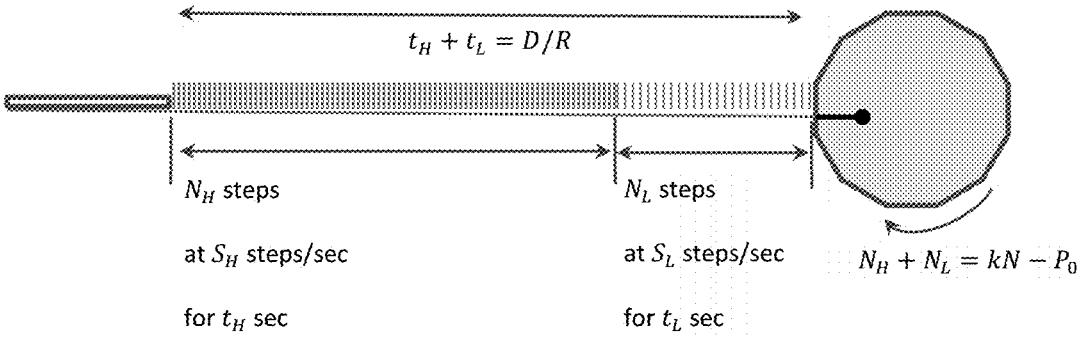

FIG. 4 is a schematic view like FIG. 3 showing the second speed correction needed to get the spindle wheel speed ready for entry of the leading edge.

Figure 5:
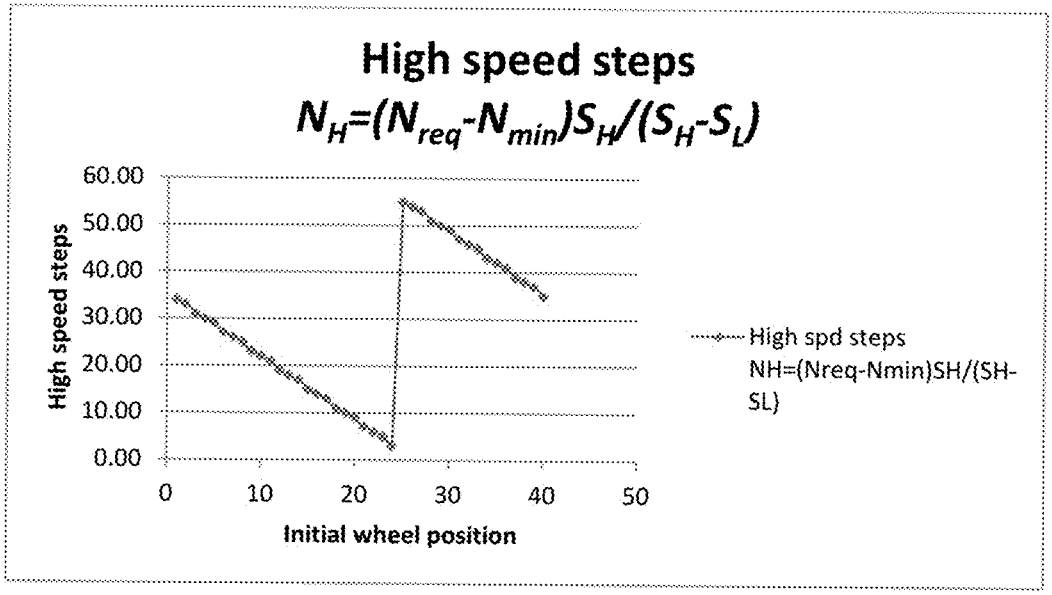
Figure 6:
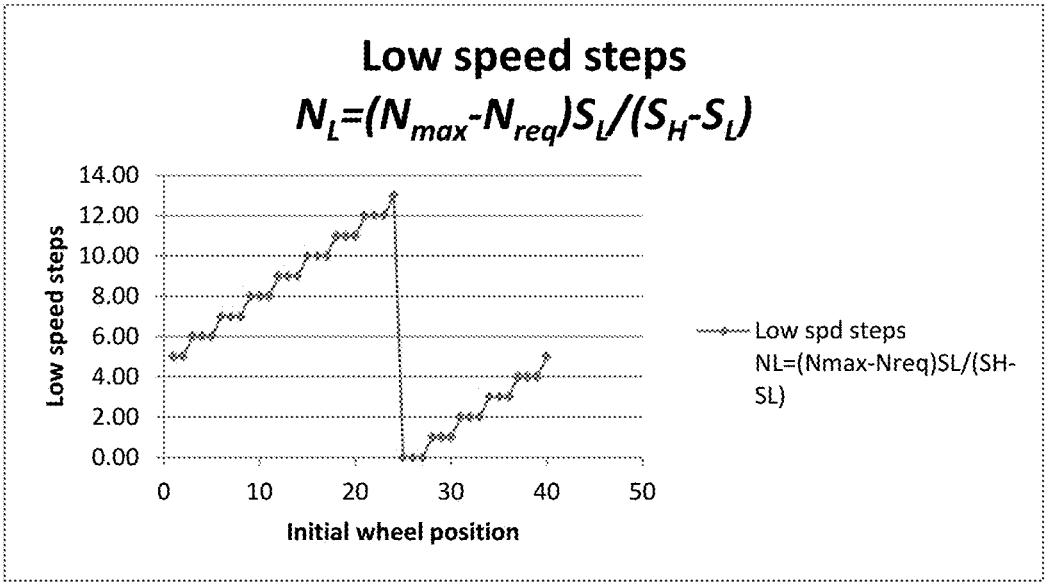
Figure 7:
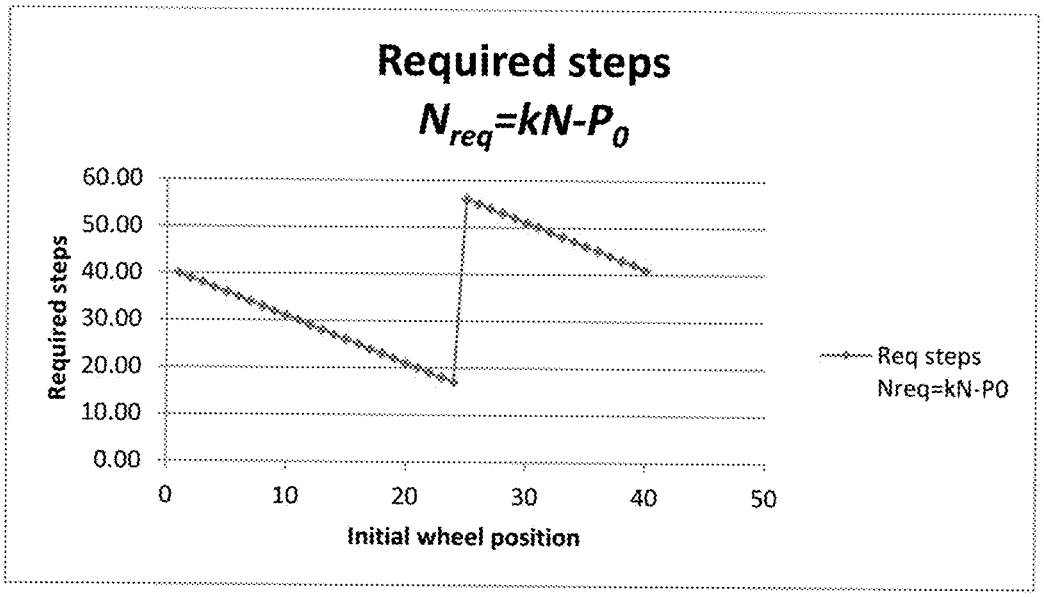

FIGS. 5, 6, and 7 are graphs of the number of high-speed wheel steps ($N_H$), low-speed wheel steps ($N_L$), and total required wheel steps ($N_{req}$) computed as functions of the wheel's position $P_0$ at the instant a document's leading edge begins to traverse the gap between the track sensor and the wheel entry point.

DETAILED DESCRIPTION

A solution to the above mentioned problems are achieved by this invention. In general, instead of starting and stopping the spindle wheel, operating the wheel continuously provides higher reliability and throughput. It also prevents the stacking function from being the bottleneck to increasing scanner throughput speeds.

A continuously running spindle could improve pocketing/stacking by:

a. moving its spindle fingers into position more smoothly and accurately because the wheel is already in motion and changes in momentum are minimized;
b. reducing spindle finger vibration by eliminating abrupt starting and stopping;
c. requiring less torque from the motor and hence less expensive motor drive electronics and motors;

d. reducing the required precision response of stepper motors and their controls;
e. making the closed loop control system more efficient;
f. eliminating command transmission time from master to slave modules;
g. being more responsive to document position information;
h. allowing spindles of larger radius to be used;
i. eliminating the need to configure a consistent stopping position, which is speed-dependent.

It must be recognized that achieving a uniform spindle stopping position is difficult at any speed due to the problems inherent in stopping and starting. The predicament is exacerbated at higher speeds.

Initial pocket spindle setup can be complicated and adjustment is difficult. It is hard to do this in the field and train users how to do it. Therefore, the prior solutions are not as user friendly. Spindle wear can also create alignment problems.

Spindle fingers vibrate up and down and can pinch documents causing inconsistent leading edge (LE) placement in a spindle. This problem is magnified when multiple spindles are used side by side to catch a document. Fingers on each spindle could be vibrating asynchronously, increasing the likelihood of a document jam.

In the present disclosure, we adjust the spindle wheel control logic by providing precise transport document position information to adjust the spindle wheel speed dynamically to position spindle fingers for document handling. A more predictable and responsive pocket spindle control system will result. This will create a pocketing system that is easier to setup initially and maintain once in the field, makes it easier to consistently produce neatly stacked documents, reduces the wear on spindles over time, and reduces the amount of maintenance required for a pocket during a machine's service life. These improvements essentially makes the pocketing system self-adjusting.

Several undesirable aspects of pocket behavior (i.e. insertion of a document into the fingers) can be improved by avoiding stopping/starting the pocket spindle during a scan session. Although the wheel has specific optimal entry positions, the arrival of the document at the wheel is a randomly timed event; using only a single wheel (fixed) speed would thus result in poor pocketing behavior since the document's arrival at the wheel would typically occur with the wheel being in a random position. The wheel's motion must therefore be carefully managed in order to coordinate the arrival of the document at the wheel with the arrival of the wheel at an entry position.

With a fixed track speed on the document conveyor and a track/position sensor at a fixed distance from the entry point, it is possible to know the position of the spindle wheel the instant the document reaches the sensor(s) and thereby manage the wheel position. The wheel has multiple entry points based on the number of fingers and slots therebetween. Indeed, the amount of angular wheel motion needed to reach any entry position is known at that instant, as is the amount of time over which this motion must occur. The controlling logic need only ensure that the wheel motor move through the required angular rotation over the required time interval to accomplish the goal of getting the gap/slot between fingers and the document's arrival to coincide.

To know this information, this system can receive inputs including the following:

(1) traversal distance of the document;
(2) traversal speed of the document;
(3) notification of traversal start (leading edge of document);
(4) wheel position at traversal start.

It is then possible to compute as output:

(1) amount of motion in the spindle wheel needed to reach target entry position (gap/slot);
(2) control parameters to accomplish desired motion.

Note that a stepper motor is still preferred over an analog device with a rotation position sensor, though either is possible. Thus rotation or amount of motion is also convertible into "number of wheel steps".

For this solution, we will define a spindle speed correction window and assume the following for its corresponding model:

speed correction window (the time interval during which the rotational speed of the spindle wheel may be adjusted) begins when a document's leading edge is detected by one or more elements of the track sensor;
speed correction window ends when the document's leading edge reaches the spindle entry point (the slot between fingers);
the track sensor and spindle entry point are a predetermined fixed distance D apart;
the spindle will rotate at least two predetermined speeds, Nominal Speed $S_H$>Insert Speed $S_L$ (steps/sec). The insert speed is the speed at which the document enters the spindle slot.
spindle position is tracked continuously and its value will be stored in a position register;
when the document hits the track sensor, the spindle is moving at Nominal Speed $S_H$;
when the document hits the spindle entry point, the spindle is moving at Insert Speed $S_L$.

The spindle's position will be tracked continuously using a processor with logic, sensor information, and preferably information gathered from encoder electronics in the spindle drive motor or by a position sensor therein. Data received about the spindle's physical characteristics will be used to monitor the relationship between the spindle's current position and spindle entry points (spindle slot/fingers).

The goal of the correction window is to determine the number of steps the spindle must run at $S_H$ and the number of steps the spindle must run at $S_L$ in order to hit the spindle at a valid entry point for the document. A valid point of entry is one where the leading edge of the document can penetrate the slot without colliding with a finger.

The Nominal Speed $S_H$ is a wheel speed that is at or near transport track speed, which can be fixed or adjustable. The Insert Speed $S_L$ is a predetermined wheel speed that will allow a document to be sufficiently inserted into the spindle wheel to match a holding catch of the document and flip it over.

If the transport speed is R (in/sec), the value of time interval T for the correction window can be calculated by dividing the distance value D by the transport speed R:

$$T = \frac{D}{R}$$

Using this definition of the time interval, we can define $t_L$ as a portion of the interval T that the spindle wheel moves at the Insertion Speed $S_L$. During the remainder of the defined time interval, the spindle will move at Nominal Speed $S_H$. These assumptions can be expressed in the equation $$S_H \cdot (T - t_L) + S_L \cdot (t_L) = N_{req}$$

$$r_L = \frac{N_{req} - S_H T}{S_L - S_H}$$

$t_L$ is the time required to correct the wheel position during the correction window.

Figure 1:
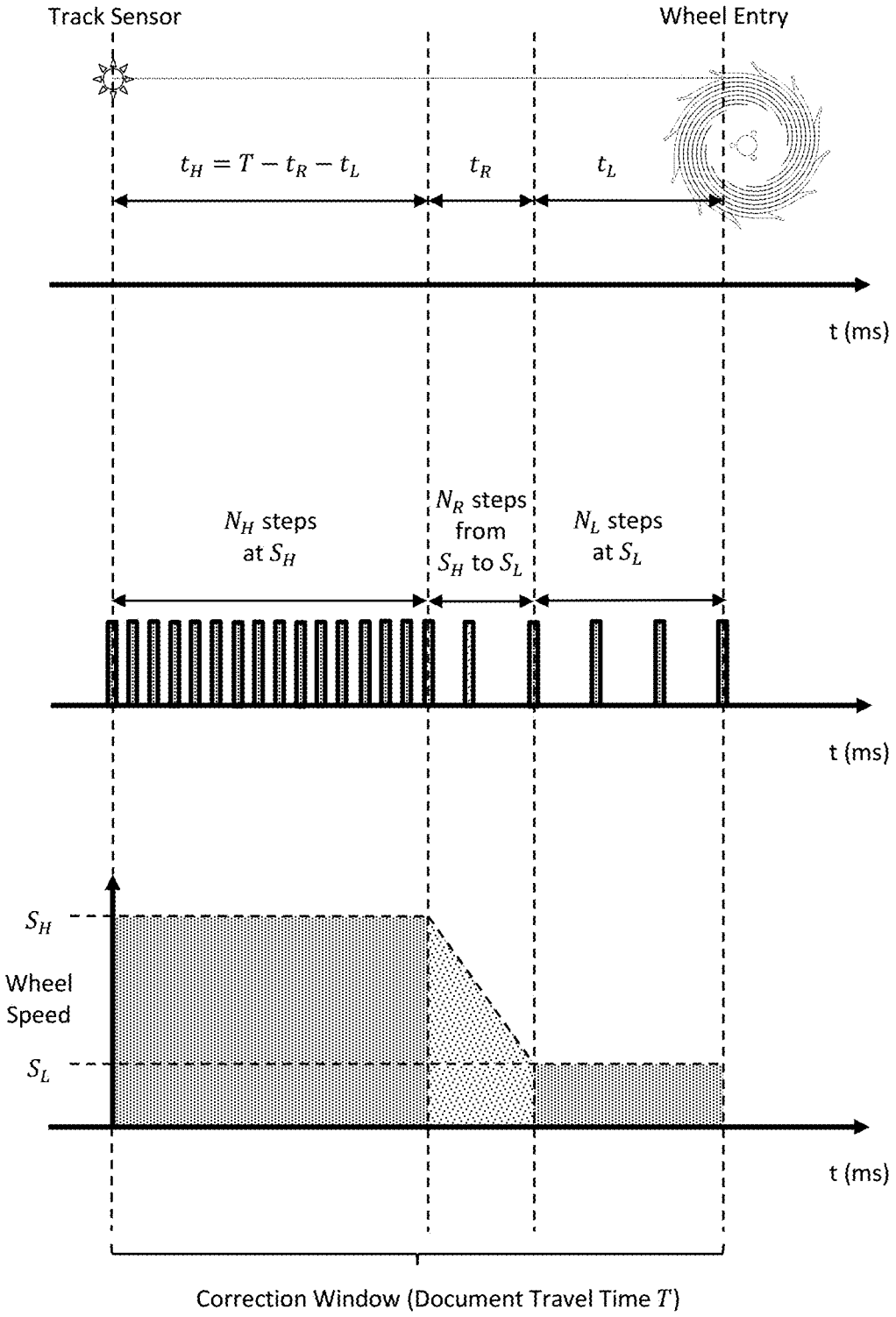
FIG. 1 is a schematic illustration of a document scanner, transfer belt, and timing in steps to the spindle wheel.

FIGS. 1, 3, and 4 illustrate the relationship (we take $t_R=0$ and $N_R=0$ for this simpler non-ramping solution). Using these figures, the basic physical assumptions of this model are the following:

(D1) the sensor and the wheel entry point are located D inches apart;

(D2) the document travels at track speed R in/sec during traversal of the sensor/entry gap;

(W1) the wheel moves at two distinct speeds, $S_L<S_H$ (steps/sec), steps being the stepper motor increments;

(W2) the document can enter the wheel at position 0;

(W3) successive entry positions are located N steps apart;

(I1) at sensor hit/detection, the wheel is moving at speed $S_H$ and is at position $P_0$ ($0 \le P_0 < N$);

(I2) at spindle wheel entry point, the wheel is moving at speed $S_L$ and is at an entry position/slot;

(I3) the wheel changes speed once between sensor hit and wheel entry. With these assumptions, we wish to calculate how many steps $N_H$ and $N_L$ the wheel must move at the corresponding speeds $S_H$ and $S_L$ after the document hits the sensor in order for the document to arrive at the wheel entry point just as the wheel has stepped into an entry position, i.e. an open slot.

There are two constraints that preferably should be met. First, the wheel stepping should take place over an interval of time equal (or nearly equal due to slot width) to the time it takes the document to traverse the gap. Second, the wheel must be in an entry position at the time the document arrives at the wheel entry point.

Conditions (D1) and (D2) tell us that the document will traverse the gap in D/R seconds. On the other hand, the wheel can move $N_i$ steps at $S_i$ steps/sec in $N_i/S_i$ seconds, so the first constraint requires that $$\frac{N_H}{S_H} + \frac{N_L}{S_L} = \frac{D}{R}$$

The total number of steps the wheel moves during traversal is $N_H+N_L$, so the wheel will have advanced from its position at sensor hit of $P_0$ to some entry position. By conditions (W2) and (W3), entry positions are precisely those of the form kN for integral k, so the second constraint requires that $$N_H+N_L+P_0=kN$$

The two constraints therefore yield the system of equations (after slight rearrangement)

$$\begin{cases} \dfrac{N_H}{\left(\frac{D}{R} - t_R\right)S_H} + \dfrac{N_L}{\left(\frac{D}{R} - t_R\right)S_L} = 1 \\ \dfrac{N_H}{kN - P_0 - N_R} + \dfrac{N_L}{kN - P_0 - N_R} = 1 \end{cases}$$

Since both $N_i$ must be nonnegative, this limits each $N_i$ to the range $0 \le N_i \le (D/R)\ S_i$. Thus there will be at most a finite number of k for which this system has solutions.

Figure 2:
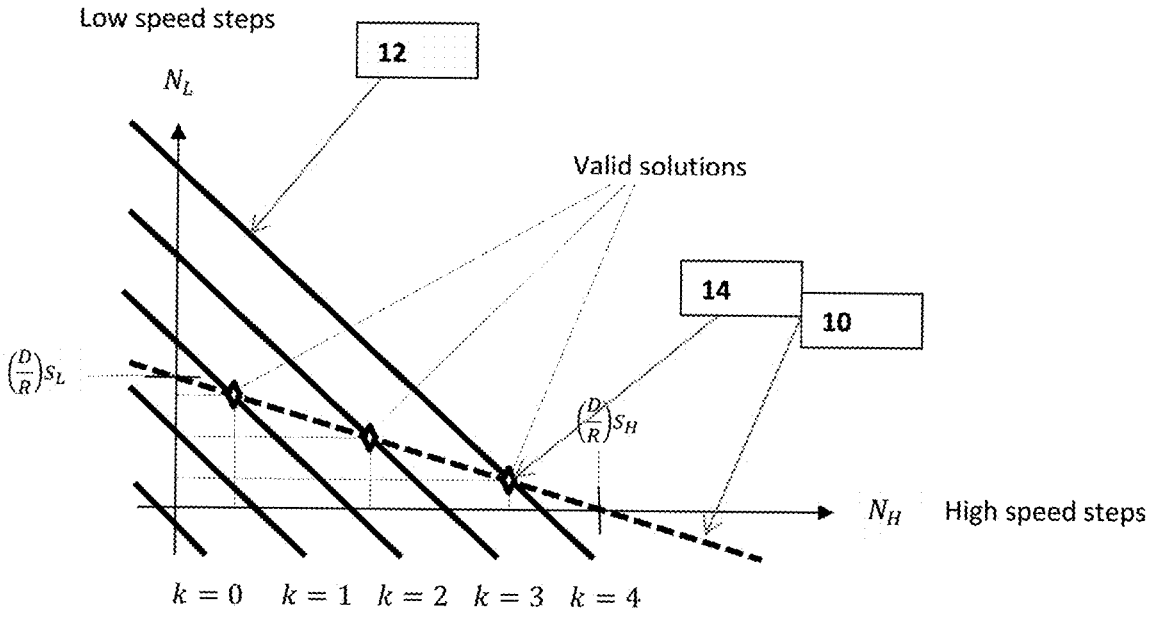
FIG. 2 is a plot of the system of equations.

This system of equations can be plotted as shown in FIG. 2. The first equation in the system is graphed as a heavy dashed line and the second is graphed as heavy solid lines corresponding to various values of k. The points of intersection in the first quadrant, marked with heavy diamonds, represent valid solutions (step count pairs ($N_H$, $N_L$) meeting both constraints and lying in the constrained ranges).

Another approach would be to always include a fixed ramp down ("ramping" refers to transitioning between two speeds gradually, visiting several intermediate speeds over time rather than switching between the two speeds instantaneously) in the motor control procedure. This means a known number $N_R$ of ramp steps, and a known period $t_R$ of ramp time, would always be reserved before computing $N_H$ and $N_L$. Writing $t_H \equiv N_H/S_H$ and $t_L \equiv N_L/S_L$ we have the generalized requirements:

$$\begin{cases} t_H + t_R + t_L = \dfrac{D}{R} \\ N_H + N_R + N_L = kN - P_0 \end{cases}$$

This can be written as:

$$\begin{cases} \dfrac{N_H}{\left(\frac{D}{R} - t_R\right)S_H} + \dfrac{N_L}{\left(\frac{D}{R} - t_R\right)S_L} = 1 \\ \dfrac{N_H}{kN - P_0 - N_R} + \dfrac{N_L}{kN - P_0 - N_R} = 1 \end{cases}$$

and has the solution:

$$\begin{cases} N_H = \dfrac{S_H}{S_H - S_L}\left[(kN - P_0) - \left(N_R + \left(\frac{D}{R} - t_R\right)S_L\right)\right] \\ N_L = \dfrac{S_L}{S_H - S_L}\left[\left(N_R + \left(\frac{D}{R} - t_R\right)S_H\right) - (kN - P_0)\right] \end{cases}$$

$kN-P_0$ is the total number of wheel steps moved by the wheel during gap traversal ("gap traversal" refers to the motion of the document's leading edge between the track sensor and the wheel entry point).

$$N_R + \left(\frac{D}{R} - t_R\right)S_L$$

is the minimum number of wheel steps that the wheel could possibly move during gap traversal.

$$N_R + \left(\frac{D}{R} - t_R\right)S_H$$

is the maximum number of wheel steps that the wheel could possibly move during gap traversal.

So we have the bounds $$N_R + \left(\frac{D}{R} - t_R\right)S_L \le kN - P_0 \le N_R + \left(\frac{D}{R} - t_R\right)S_H$$

which means $$\frac{N_R + \left(\frac{D}{R} - t_R\right)S_L + P_0}{N} \le k \le \frac{N_R + \left(\frac{D}{R} - t_R\right)S_H + P_0}{N}$$

The last possible valid value of k then is $$k_{last} = \left\lfloor \frac{N_R + \left(\frac{D}{R} - t_R\right)S_H + P_0}{N} \right\rfloor.$$

Note that taking $N_R = t_R = 0$ yields the results for the simple model (which does not include a ramp between high and low speeds), as expected.

The bounding inequalities for k may be written as $u+\epsilon \le k \le v+\epsilon$, where we take $$u = \left(\frac{N_R}{N}\right) + \left(\frac{D}{R} - t_R\right)\left(\frac{S_L}{N}\right),\ v = \left(\frac{N_R}{N}\right) + \left(\frac{D}{R} - t_R\right)\left(\frac{S_H}{N}\right),$$

and $$\epsilon = \frac{P_0}{N}.$$

This means that the interval $[u+\epsilon, v+\epsilon]$ must contain an integer for all $0 \le \epsilon < 1$, which in turn requires that u and v be at least 1 unit apart:

$$\left(\frac{N_R}{N}\right) + \left(\frac{D}{R} - t_R\right)\left(\frac{S_H}{N}\right) - \left[\left(\frac{N_R}{N}\right) + \left(\frac{D}{R} - t_R\right)\left(\frac{S_L}{N}\right)\right] \ge 1$$

$$\left(\frac{D}{R} - t_R\right)\left(\frac{S_H - S_L}{N}\right) \ge 1$$

$$S_H - S_L \ge \frac{N}{\left(\frac{D}{R} - t_R\right)} = \frac{NR}{D - Rt_R}$$

This is the requirement imposed on the high and low speeds to guarantee that an entry position can be reached. Since $S_L > 0$, this means that $S_H$ must be greater than $$\frac{NR}{D - Rt_R}.$$

Defining:

$$N_{req} \equiv kN - P_0$$

$$N_{min} \equiv \left(\frac{D}{R} - t_R\right)S_L$$

$$N_{max} \equiv \left(\frac{D}{R} - t_R\right)S_H$$

we can write the original system as:

$$\begin{cases} \frac{N_H}{N_{max}} + \frac{N_L}{N_{min}} = 1 \\ \frac{N_H}{N_{req}} + \frac{N_L}{N_{req}} = 1 \end{cases}$$

and the solution as:

$$\begin{cases} N_H = r_H \cdot (N_{req} - (N_{\min} + N_R)) \\ N_L = r_L \cdot ((N_{max} + N_R) - N_{req}) \end{cases}$$

where $r_H$ and $r_L$ are the ratios of the two corresponding wheel speeds to their common difference. Note that $N_{max}$ is the maximum number of non-ramping steps that can be generated during traversal, which occurs when all time outside of the ramp is spent at high speed (so the ramp occurs at the end of traversal); similarly $N_{min}$ is the minimum number of non-ramping steps that can be generated during traversal, which occurs when all time outside of the ramp is spent a low speed (so the ramp occurs at the beginning of traversal).

A heuristic explanation of this particular solution can now be offered. Running the wheel at high speed guarantees that one or more candidate wheel entry positions can be rotated past the entry point during any document's travel between the track sensor and the wheel; running the wheel at low speed at the end of the journey prevents the wheel from outrunning the document and permits the document to enter the more slowly moving wheel; so what remains is to decide when to transition from high speed to low speed. Transitioning early during traversal means fewer wheel steps are taken during traversal (as more time is spent at low wheel speed), and transitioning late during traversal means more wheel steps are taken (as more time is spent at high wheel speed); thus a range of wheel steps is possible during traversal. If the two speeds are sufficiently different, this range of wheel steps will be broad enough to guarantee that at least one of the step counts in the range is exactly the number of steps needed to bring the wheel to an entry position precisely at the end of traversal. This is true regardless of the position of the wheel when traversal begins; in fact, knowing the wheel position at the instant the document reaches the track sensor (i.e., beginning of traversal) allows the required combination of high speed and low speed steps to be computed immediately—in other words, when the transition from high to low speed during traversal should be made. Thus the correction window (traversal) is always of known fixed duration (the traversal time), but the position of the transition from high to low speed during this correction window is variable, because its placement depends on the wheel position at the instant traversal begins. This is what is presented more formally in the mathematics above. FIGS. 5, 6, and 7 show how the number of high-speed steps, low-speed steps, and total required steps (which are on the vertical axes of these charts) vary depending on the wheel position at the start of traversal (which is on the horizontal axis of each chart).

The following are definitions of symbols used:

D=fixed distance from track sensor to wheel entry point (in), traversed by each document;

R=fixed track speed (in/sec), traversal rate for each document;

N=fixed number of wheel steps between successive entry positions (steps);

$S_H$=fixed high-speed wheel rate (steps/sec), wheel speed at start of traversal;

$S_L$=fixed low-speed wheel rate (steps/sec), wheel speed at end of traversal;

$N_H$=number of high-speed wheel steps after traversal start (steps);

$N_R$=number of fixed high-to-low ramp steps during traversal (steps);

$N_L$=number of low-speed wheel steps before traversal end (steps);

$t_H$=duration of high-speed stepping phase during traversal (sec);

$t_R$=duration of fixed high-to-low ramp stepping during traversal (sec);

$t_L$=duration of low-speed stepping phase during traversal (sec);

$P_0$=wheel position at traversal start (steps), relative to most recently exposed entry position;

k=index of potential entry position reachable by traversal end;

$k_{last}$=index of last possible entry position reachable by traversal end;

$N_{req}$=number of wheel steps required to reach entry position at end of traversal;

$N_{min}$=minimum possible wheel steps outside of ramp during any traversal (steps);

$N_{max}$=maximum possible wheel steps outside of ramp during any traversal (steps);

$r_H$=ratio of high wheel speed to difference of high and low wheel speeds;

$r_L$=ratio of low wheel speed to difference of high and low wheel speeds.

FIG. 3 illustrates determining the required number of wheel steps to reach an entry position.

FIG. 4 illustrates wheel position correction.

The following is a glossary of terms:

Entry point—the point at which the paper path meets the pocket wheel or the pocket wheel slot.

Entry position—the position of the wheel in which a spindle slot opening is optimally aligned with the paper path to permit insertion without rejection or substantial resistance.

Insertion speed—preferably the lowest spindle wheel speed. The wheel runs at insertion speed as the document is entering a spindle.

Nominal speed—preferably the highest wheel speed. The wheel runs at nominal speed between correction cycles.

Track sensor—the sensor along the document paper path used to detect when traversal begins.

Track speed—the speed (in/sec) at which all documents move along the document paper path before the entry point.

Traversal—the motion of a document's leading edge between the track sensor and the entry point on the spindle wheel.

Wheel position—the number of steps the spindle wheel has moved/rotated past the last entry position.

FIGS. 5, 6, and 7 are graphs of wheel motor high-speed steps, low-speed steps, and required steps (vertical axis) as functions of wheel position at the start of traversal (horizontal axis).

The description of the invention and its applications as set forth herein is illustrative and is not intended to limit the scope of the invention. Variations and modifications of the embodiments disclosed herein are possible and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A system for stacking flexible sheets having a leading edge, the system comprising:

a. a transfer belt configured to move in a transverse direction to move a sheet transversely therealong at a predetermined speed;

b. at least one sensor located proximate the belt, positioned to detect a sheet;

c. a rotatable stacking spindle wheel having a central core and a plurality of fingers extending generally outwardly from the core, said fingers defining a slot therebetween, said wheel located adjacent said belt;

d. a motor connected to said wheel for rotating said wheel; and e. a controller configured to control the rotational speed of said motor and to received position data from said sensor; said controller configured to adjust the rotational speed of said wheel to a constant speed during a sheet arrival to ensure that when the leading edge of the sheet arrives at said wheel, it is directly received within said slot, so that it can be flipped over by said wheel and released therefrom for stacking after sufficient rotation of the wheel.

2. The system of claim 1 wherein the controller is configured to adjust the wheel speed from a first speed where the sheet is traveling along the transfer belt after said leading edge has been detected by the sensor, a second constant speed after the sheet is detected by the sensor but before it arrives at the wheel, and a third constant speed at the moment before the leading edge reaches the wheel.

3. The system of claim 2 wherein said second speed is a substantially linear transition in speed from said first speed.

4. The system of claim 2 wherein the second speed is a progression from the first to the third constant speed.

5. The system of claim 2 wherein the second speed is variable with a final speed adapted to insert the leading edge of the sheet at least part way into the slot without encountering a finger.

6. The system of claim 1 wherein the controller is configured to adjust the wheel speed from a first speed where the sheet is traveling along the transfer belt after said leading edge has been detected by the sensor, a second variable speed after the sheet is detected by the sensor but before it arrives at the wheel, and a third constant speed at the moment before the leading edge reaches the wheel.

7. A method of stacking flexible sheets traveling on a transfer belt with the sheets in one orientation and stacking them, each sheet having a leading edge, a sheet pickup spindle wheel located proximate the end of the belt, the wheel having a plurality of fingers and slots between the fingers, comprising the steps of:

a. moving a sheet along a transfer belt at a predetermined speed;

b. once the sheet is moving on the transfer belt, continuously rotating the spindle wheel without stopping;

c. detecting the leading edge of the sheet while moving the sheet on the belt at the predetermined speed;

d. calculating when the leading edge will reach the spindle wheel;

e. as the sheet approaches the wheel, adjusting the rotational speed of the wheel to a constant speed such that when the leading edge reaches the spindle wheel, the leading edge will directly engage a slot between fingers;

f. rotating the wheel to flip over the sheet from one orientation to the reverse orientation in order to preserve the original stacking order of the documents; and g. stacking the sheet.

8. The method of claim 7 wherein said wheel is rotated in discrete steps.

9. The method of claim 7 wherein the speed of the wheel starts at a high speed and changes to a lower speed suitable for receiving the leading edge with the speed of rotation, in incremental steps being calculated as follows:

$$\begin{cases} N_H = r_H \cdot (N_{req} - (N_{min} + N_R)) \\ N_L = r_L \cdot ((N_{max} + N_R) - N_{req}) \end{cases}$$

wherein $N_H$=Number of high-speed-wheel steps after traversal along the belt starts (in incremental steps of rotation);

$N_R$=Number of steps as the wheel rotation decreases from a fixed high-to-low ramp steps during traversal of the sheet along the belt (in steps);

$N_L$=Number of lower-speed wheel steps just before traversal along the belt end (in steps);

$N_{req}$=Number of steps required to reach entry position at end of traversal of the leading edge from the belt to the wheel;

$N_{min}$=Minimum possible steps beyond transfer belt during any traversal (in steps);

$N_{max}$=Maximum possible steps outside of ramp during any traversal (in steps);

$r_H$=Ratio of high wheel speed to difference of high and low wheel speeds; and $r_L$=Ratio of low wheel speed to difference of high and low wheel speeds.

10. The method of claim 7 wherein the step of continuously rotating the spindle wheel without stopping includes, rotating the wheel at a first predetermined speed, the adjusting the rotation of the wheel toward a second speed, and adjusting the speed to a third constant speed which is calculated to align a slot between fingers with the leading edge sheet.

11. The method of claim 10 wherein the second speed is a plurality of speed adjustments to bridge between the first speed and third constant speed.

12. The method of claim 10 wherein said bridge speed is substantially linear to minimize sudden changes in momentum of the wheel.

13. A scanning and stacking system for stacking flexible sheets received from a scanning track, the sheets having a leading edge, the system comprising:

a. a transfer belt configured to move in a transverse direction to move a sheet transversely therealong at a predetermined speed;

b. at least one sensor located proximate the belt, positioned to detect a sheet;

c. a rotatable stacking spindle wheel having a central core and a plurality of fingers extending generally outwardly from the core, said fingers defining a slot between the fingers, said wheel located adjacent said belt;

d. a motor connected to said wheel for rotating said wheel; and a controller configured to control the rotational speed of said motor and to received position data from said sensor; said controller configured to adjust the rotational speed of said wheel to ensure that when the leading edge of a sheet arrives at said wheel, it is directly received within said slot, so that it can be flipped over by said wheel and released therefrom for stacking after further rotation of the wheel, and wherein the controller is configured to adjust the wheel speed from a first speed where the sheet is traveling along the transfer belt after said leading edge has been detected by the sensor, a second speed after the sheet is detected by the sensor but before it arrives at the wheel, and a third constant speed at the moment before the leading edge reaches the wheel.

* * * * *